US005550349A

United States Patent [19]

Bomba

[11] Patent Number: 5,550,349

[45] Date of Patent: Aug. 27, 1996

[54] SNOW PROTECTION AND REMOVAL SYSTEM

[76] Inventor: Fidelis Bomba, 585 Morris Ave., Orange, N.J. 07050

[21] Appl. No.: 257,002

[22] Filed: Jun. 8, 1994

[51] Int. Cl.[6] ..... H05B 3/28; E04B 7/16

[52] U.S. Cl. ..... 219/213; 219/548; 392/437; 52/66

[58] Field of Search ..... 219/213, 522, 219/548, 200–201; 392/432, 435, 436, 437; 52/67, 69, 126.3, 126.6, 66, 74, 90.2; 37/196, 197, 226, 227; 126/271.1, 271.2 R; D25/34; 248/161, 188.5, 650

[56] References Cited

U.S. PATENT DOCUMENTS

| | | | |
|---|---|---|---|
| 2,912,555 | 11/1959 | Jamison | 219/213 |
| 3,060,519 | 10/1962 | Francis | 52/66 |
| 3,129,316 | 4/1964 | Glass et al. | 219/213 |
| 3,445,628 | 5/1969 | Bateman, Sr. | 219/213 |
| 3,629,555 | 12/1971 | Herbert, Jr. | 392/435 |
| 3,806,702 | 4/1974 | Spencer | 219/213 |
| 3,925,995 | 12/1975 | Harmsma et al. | 405/299 |
| 4,783,934 | 11/1988 | Langhart et al. | 52/66 |
| 4,928,444 | 5/1990 | Horie et al. | 52/66 |

*Primary Examiner*—Teresa J. Walberg
*Assistant Examiner*—Raphael Valencia
*Attorney, Agent, or Firm*—Clay Holland, Jr.

[57] ABSTRACT

An unmanned snow prevention and removal system is provided which prevents or eliminates the accummulation of falling snow in selected ingress and egress passageways on the ground, such as sidewalks and driveways. An array of disposed parallel linear cooperative panels is provided covering such passageways upon which the accumulated falling snow is caught, and is subsequently intermittently and automatically thrown off such panels on wither side of their respective lengths by their sweeping motion through an arc of a circle from an initial near horizontal intersecting position by an electrical motor drive. Removal of accumulated snow from the panel array during their sweeping-throw and return motion as a result of the snow sliding downward of the panels is assisted by the provision of electrical heater elements disposed along the full length thereof and contained within the body of each panel which enables the accumulated snow to slide off the panel more readily. Operation of the system may be controlled by electrical controls at the site of the panel array or by means of a remote electrical control device connected thereto by electrical wiring cables which provide the electrical signals needed to operate the system.

18 Claims, 6 Drawing Sheets

FIG. 10

REPRESENTATIVE FUNCTIONS

- (•) CONTROL ELECTRICAL POWER ON-SWITCH
- (X) CONTROL ELECTRICAL POWER OFF-SWITCH
- (T) SYSTEM-TEST-USE TO TEST CONDITION OF SYSTEM
- (S) SYSTEM-SET - FOR ULTRASOUND DEVICE OPERATIONS-
- (R) RED INDICATOR LIGHT- SYSTEM OFF, AND PANELS OPEN
- (G) GREEN INDICATOR LIGHT-PANELS CLOSED-SYSTEM ON
- (O) ORANGE INDICATOR LIGHT-PANELS OPEN-SYSTEM ON
- (I) TIME INTERVAL DEVICE FOR SETTING FREQUENCY PANEL OPENING & CLOSING
- (TD) SPEED CONTROL DEVICE-FOR SETTING TIME CYCLE SPEED
- (HS) HEIGHT SETTING DEVICE- RAISING OR LOWERING PANELS
- (E) ENTER BUTTON

SNOW PROTECTION AND REMOVAL SYSTEM

FIELD OF THE INVENTION

This invention relates to a system for the prevention of the accumulation of falling snow flakes in desirable areas of real property, such as sidewalks, driveways and the like. More particularly, this invention relates to systems or devices that may be utilized to remove snow from selected areas of sidewalks and driveways as examples, or devices used to prevent the accumulation of snow thereon while such passageways are not in traffic use or permitting the use thereof at selected intervals during or after a snow storm.

BACKGROUND OF THE INVENTION

Snow flake accumulation concerns become increasingly more pronounce as people become litigation conscientious or to the aging population in the suburban areas where the practical and financial demands and cost attendant the removal of snow increases. Concurrently, both residential occupants and commercial tenants may be required by local laws or ordinances to remove snow from the sidewalks, passageways and the like. In the prior art, such snow removal is generally accomplished manually with the use of such devices as snow shovels, mechanical assisted shovels, snow blowers and plows. The latter types may be electrically or gasoline actuated. In all of the above recited means of snow removal, they each require one or more persons to physically utilize such tools or devices while exposed to the inclement weather conditions during or after a snow storm. Consequently, there has arisen a need to provide an unmanned automatic removal or prevention system which will provide a convenient means for preventing the accumulation and removal of unwanted fallen snow from selected ingress and egress passageways of residential and certain commercial properties.

Therefore, it is an object of the present invention to provide an unmanned automatic snow fall prevention and removal system which prevents or eliminates the accumulation of such falling snow from blocking or obstructing selected ground passageways areas without the need of persons to be exposed to the attendant inclement weather conditions during a snow storm.

Another object of the invention is the provision of a snow removal system which may be automatically initiated and operated from locations remote from the site of the snow removal system, to thereby eliminate the need for the operator of the system to be exposed to inclement weather of a snow storm.

It is a further object of the invention to provide a snow removal system in which the operation thereof may be periodically interrupted as needed during a snow storm to permit the passage of persons or vehicles, such as automobiles, along such ground passageways which is being protected by the panel array of the system of the present invention.

SUMMARY OF THE INVENTION

The present invention is directed toward an unmanned automatic snow removal system which substantially prevents or eliminates the accumulation of fallen snow flakes on selected ingress and egress ground passageways. In a preferred embodiment of the invention the snow removal system includes a paired array of parallel linear cooperative panels disposed covering such passageways upon which falling snow is accumulated. The panels are initially disposed in parallel abutting contact with one another along their respective lengths, each being disposed at a slight angle to the horizon. The accumulated snow caught thereon is subsequently removed therefrom by the upwards sweeping and return motion of the panel from their predisposed positions of near horizontal, as each rotates about a stationary side of the panel connected to a drive shaft actuated by an electrical motor drive device. The process of removing or throwing the accumulated snow rom the panels occurs during intermittent snow-throw and return cycles in response to a preselected amount of accumulated snow which is determined by one or more detection devices that sense and/or measure the amount of accumulated snow deposited on the panels and in response to such measurements triggers circuits to actuate sweeping-throwing and return motion of the panels so as to throw-off the accumulated snow and then to their original positions. In another aspect of the invention, removal of the accumulated snow is aided by the provision of electrical heater elements contained within each panel member that causes the snow to more loosely adhere to a nonstick material surface of each panel, thereby further facilitating the ease of removal of the snow from the panels. Another feature of the system provides adjustable extension support legs for the system that may be adjusted manually or by automatic electrical height determining devices of the system, so as to raise the paired panel array in unisons as the snow is accumulated in piles along the length of the panels during heavy snow falls so as to accommodate heavy snow fall and the need to accumulate snow in piles along such length of the panels, that may reach heights in excess of six feet. For deep snow pilings along the length of the panel snow-drift shields are provided to prevent such accumulated piles of snow from sliding onto the passageways near the base of the weighted foot support of the system.

Figure 11:
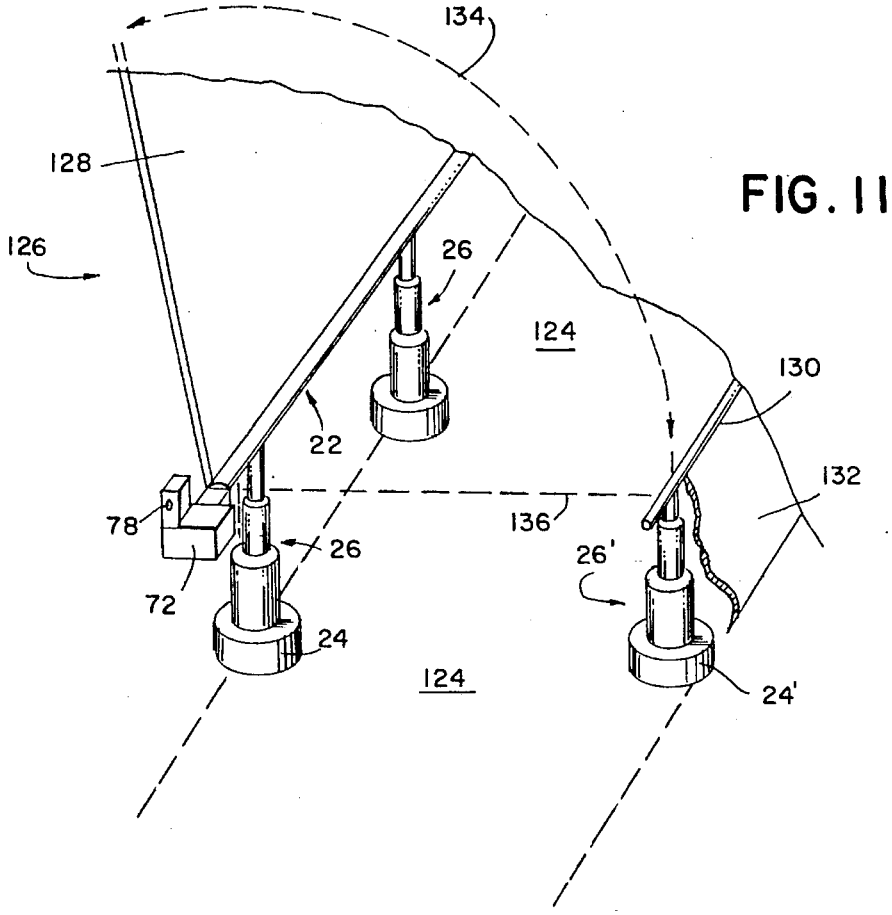
Figure 2:
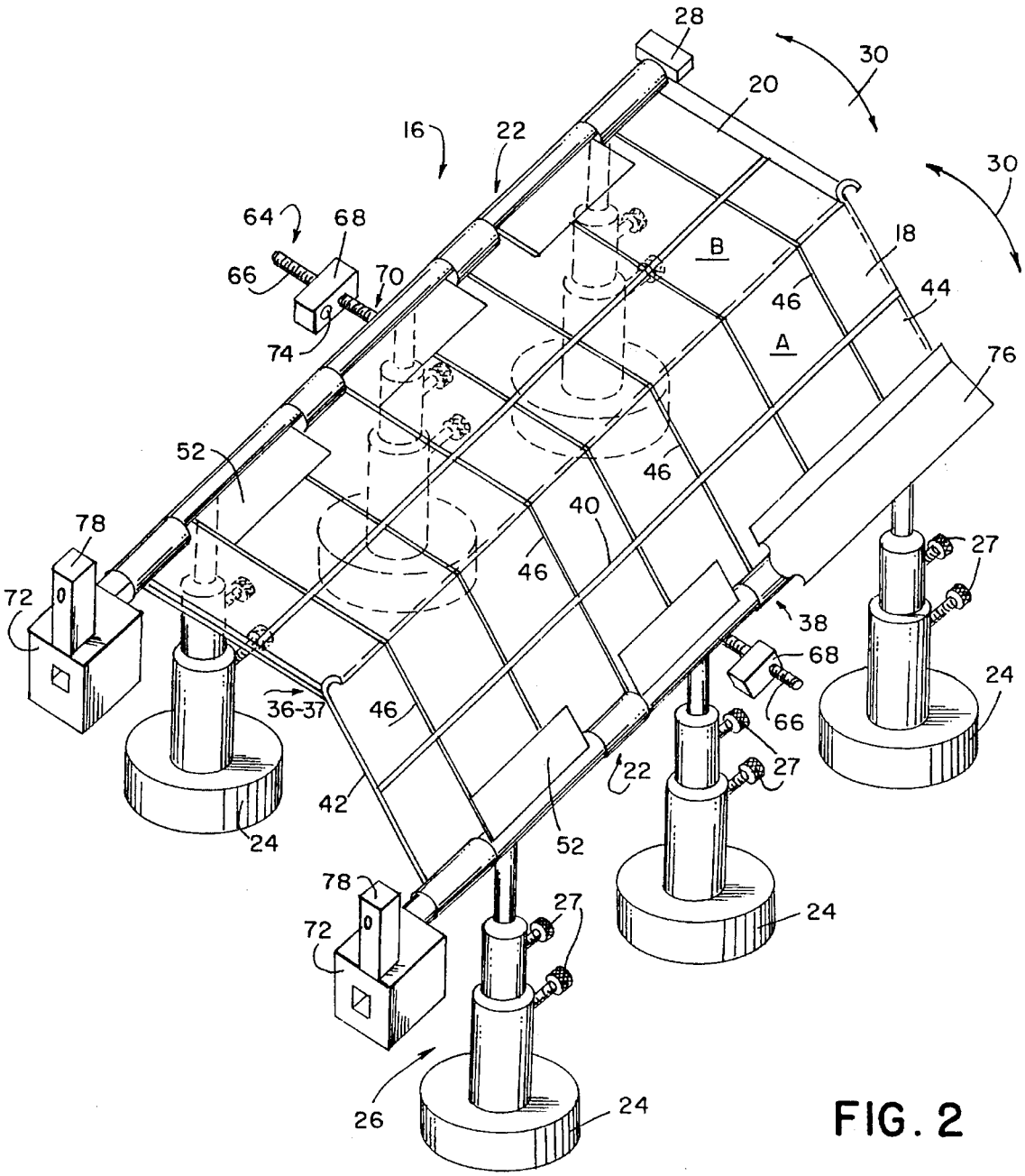
FIG. 2 is a pictorial view of a paired array of parallel panels connected to a plurality of adjustable extendable support legs or members depicting panel arrangements in accordance with the present invention.
Figure 8:
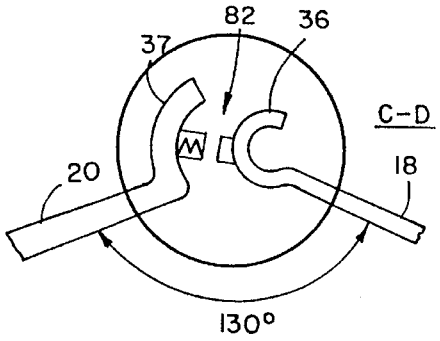
Figures 4, 5, 7:
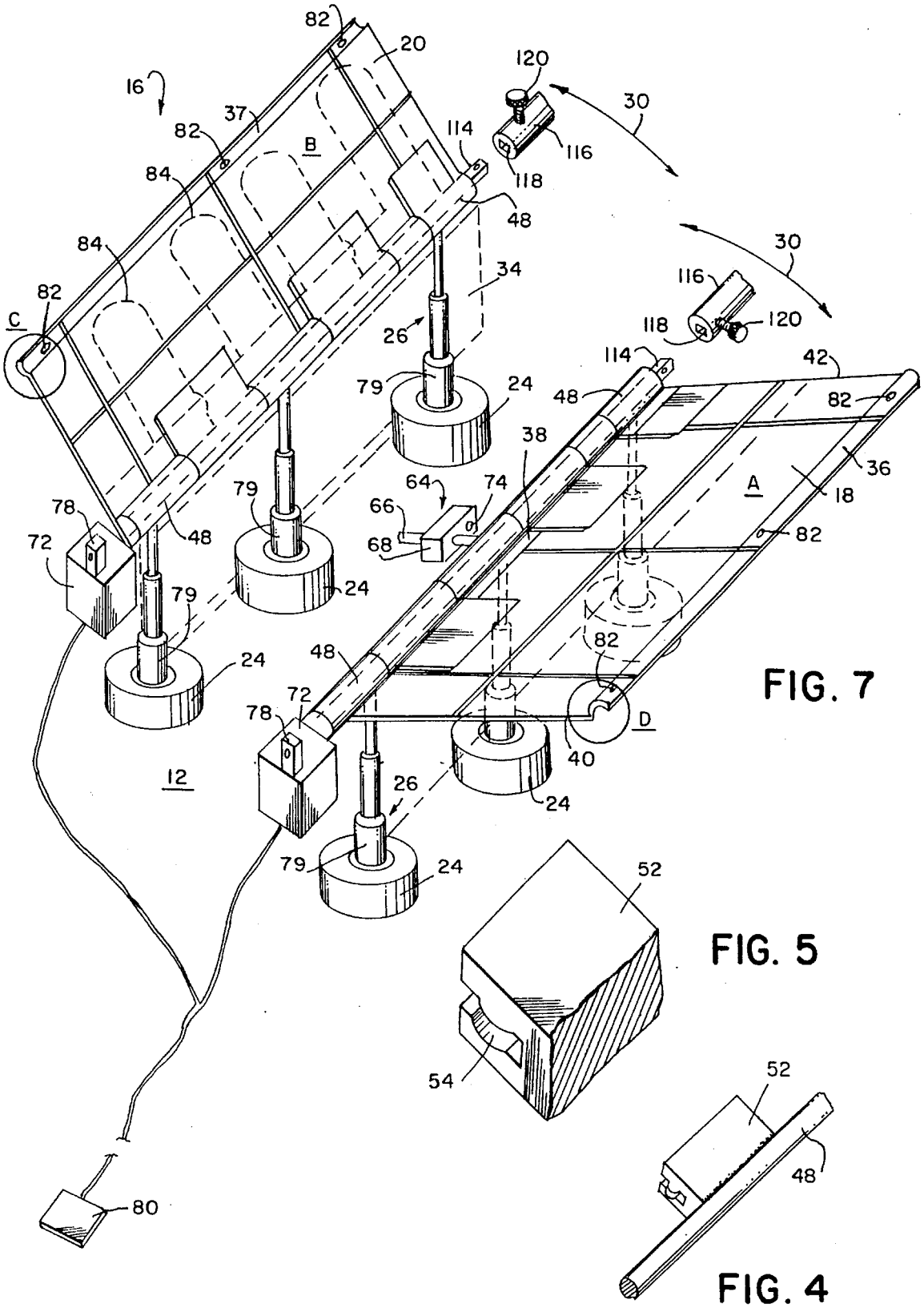
FIG. 4 is a pictorial view of a single snap-on panel holder fixedly connected to a drive shaft of the panel array shown in FIGS. 2 and 3.
FIG. 5 is a partial pictorial view of a single snap-on panel holder shown in FIG. 4.
Figure 9:
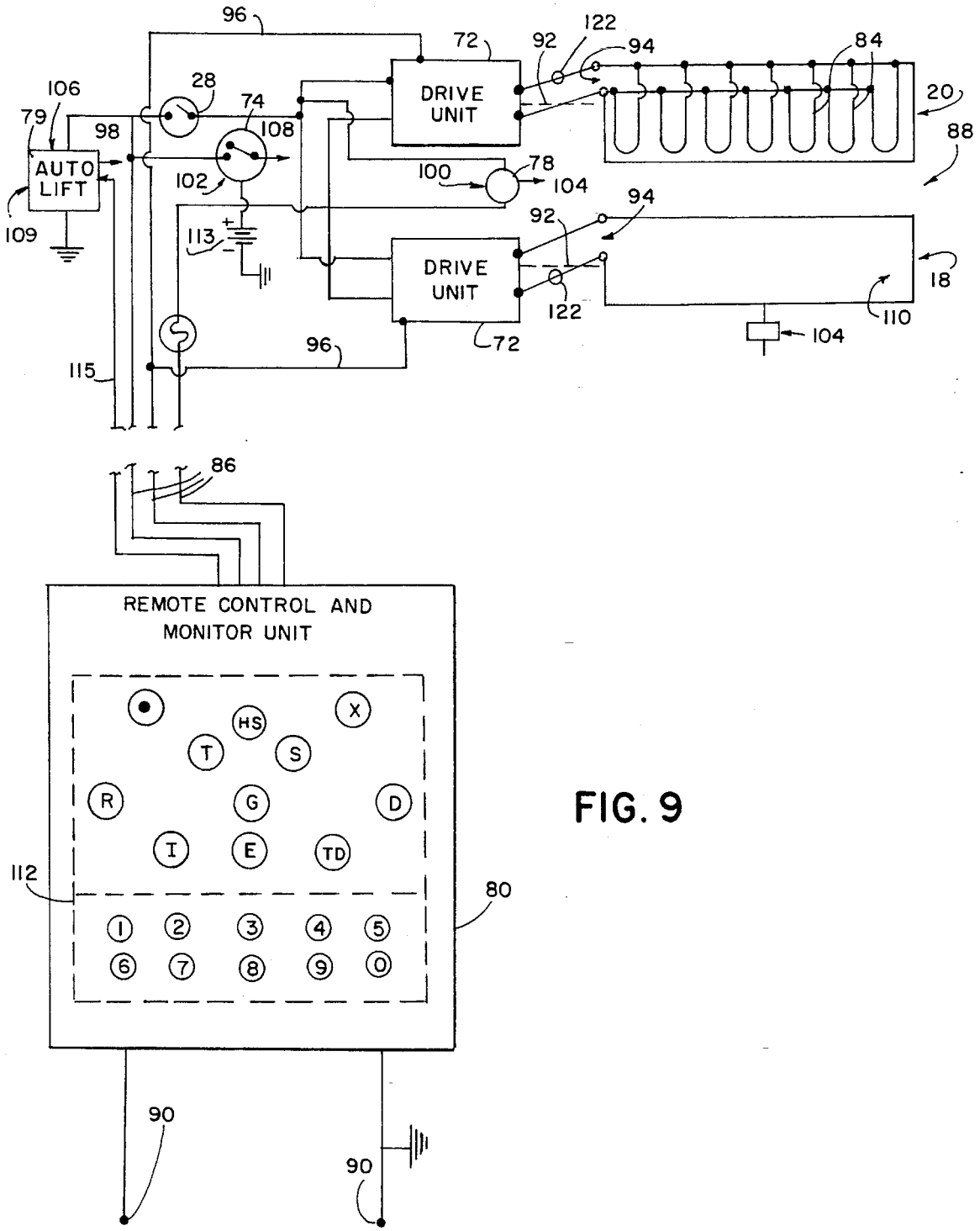

FIG. is a pictorial view of a paired array of parallel panels similar to that shown in FIG. 2, but differs in that certain details common to both are shown along with additional features which are unique to the automatic raising or lowering of the panel arrays and the presence of a snow-drift shield extending from the lower end of a panel to the weighted foot support member disposed at ground level;

FIG. 8 is a view of the encircled ends of the panel array shown in FIG. 7, designated encircled positions C and D in the figure;

FIG. 9 is a block schematic circuit diagram for the electrical system utilized with the panel array system useful for remote electrical control thereof;

FIG. 10 is a list of control unit functions and corresponding letter symbols utilized to designate selection of functions to the snow removal and prevention system in accordance with the teachings of the present invention; and FIG. 11 is a partial pictorial view of another embodiment directed toward sidewalk passageways where only one row of panels is utilized.

DETAILED DESCRIPTION OF THE DRAWINGS

Figure 1:
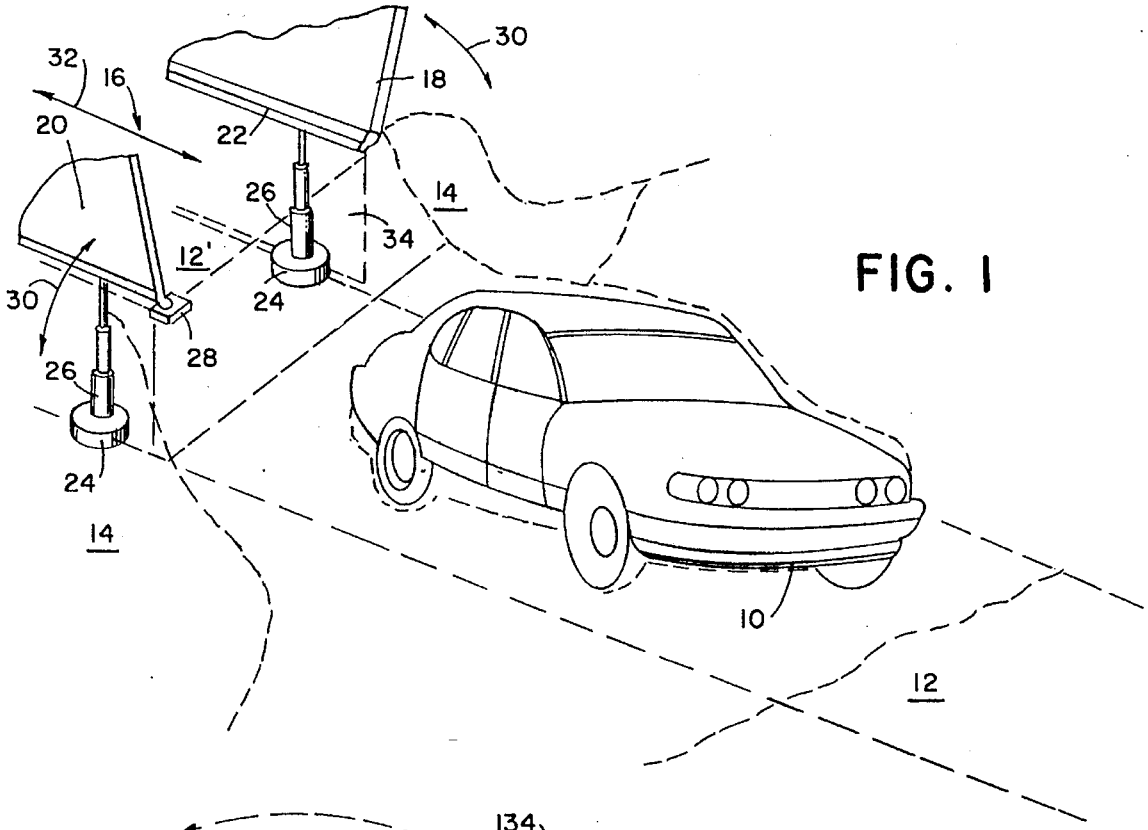
FIG. 1 of the drawings is a pictorial view of a portion of a snow removal system illustrating how a driveway passageway may be protected from the accumulation of snow so as to provide ingress and egress therealong by an automobile as depicted.

Referring now to FIG. 1, there is shown an auto mobile 10 on a passageway 12, such as a driveway, that is partially covered, in the area designated 12', by a snow prevention and removal system 16, that is shown in an opened position. System 16 is shown with fallen an piled up snow 14 on either side along the length of a pair of system panels, designated first array panel member 18 and second panel array member 20. As shown these panels are fixedly attached to their respective drive shaft bearing support assemblies 22 along a parallel side of their respective panels. The rotary motion of panels 18 and 20 is illustrated by a curved arrowed line 30, indicating the open position of panels 18 and 20, which is slightly past a vertical position.

Continuing with the description of FIG.1, a plurality of weighted foot support members 24 are provided for each panel 18 and 20, only two of the weighted foot support members are shown. Fixedly connected to each weighted support member 24 is a multisectioned extendable support leg device 26, which may be telescoped from its shortest to its tallest position. Support leg devices 26 are each fixedly connected to their respective shaft bearing support assemblies 22 and operate to raise or lower their respective panel 18 and 20 in unison. As shown in FIG. 1, extend able support legs 26 are shown fully extended to a height on the order of six feet, illustrating the ability of the system to accommodate heavy snow fall and the attendant piling up of snow that may occur during heavy snow fall, such that an automobile as shown in the figure is readily able to travel along the driveway clear of fallen snow where the system covers such area 32 owing to removal thereof by the system of the present invention.

it should be noted that when the array of panels 18 and 20 are raised to heights on the order of four to six feet, it has been found desirable or necessary to provide a snow-shield or curtain 34 with each panel 18 an 20. In order to install drift-shields 34 a switch 28 is provided which enables the panel 18 and 20 to be placed in the position as shown in FIG. 1. These drift-shields may be any suitable commercially available spring loader roller type device of suitable weather resistance material and properties that may be adapted for hanging to the drive shaft bearing support assembly 22 and being connected below to the weighted foot support members, Once the snow drift-shields have been manually connected to the system, snow which might otherwise slide or filter onto the passageway being protected by the system is substantially, if not entirely, avoided, owing to the fact that as the snow is intermittenly piled along the length of the panels it becomes sufficiently compacted by its own weight and moisture that it tends not to shift and form a compact pile or mound which stays in place flush against shields 34.

Referring now to FIGS. 2–6 there is shown in FIG. 2 a snow prevention and removal system 16, similar to that shown in FIG. 1, but is shown in greater detail. In FIG. 2, system 16 comprises a paired parallel array of two panels designated a first panel arra member 18 and a second panel array member 20. As shown each panel has a rectangular configuration where their length may be greater than their widths. Each panel comprises a sandwiched arrangement of support frame members consisting of a first and second upper frame member segments 36 and 37, and a parallel lower-frame member segment 38, parallel mid-frame member segment 42 and a second end-frame member segment 44 to form a rectangular frame between parallel segment members 36 and 37, 38 and 40 along with end-frame segment members 42 and 44. A plurality of mid-frame segments 46 which are parallel to end-frame segments 42 and 44. The panels 18 and 20 may be made of one piece construction by molding or casting, from light weight metal or plastic; and in the alternative from individual segment members of conforming configuration connected together by welding, soldering, gluing or with suitable fasteners. The preferred method would be to form such frames by molding or casting in one piece for greater sternest. To continue, each frame is sandwiched or covered by layers of suitable plastic-like materials, such as a polymeric material, of preselected thickness, having non-adherence surface properties. On one of the layers a suitable electrical heating element is deposited along the length of the panels, using deposition techniques well known in the prior art, such as nichrome wire or a conductive paint. Such heater elements are used to provide heat to each panel, such as that provided for example, as de-icing techniques on rear windows of automobiles. Once a panel has been appropriately packaged and completed it may then be combined with a drive shaft bearing support assembly 22.

Figure 3:
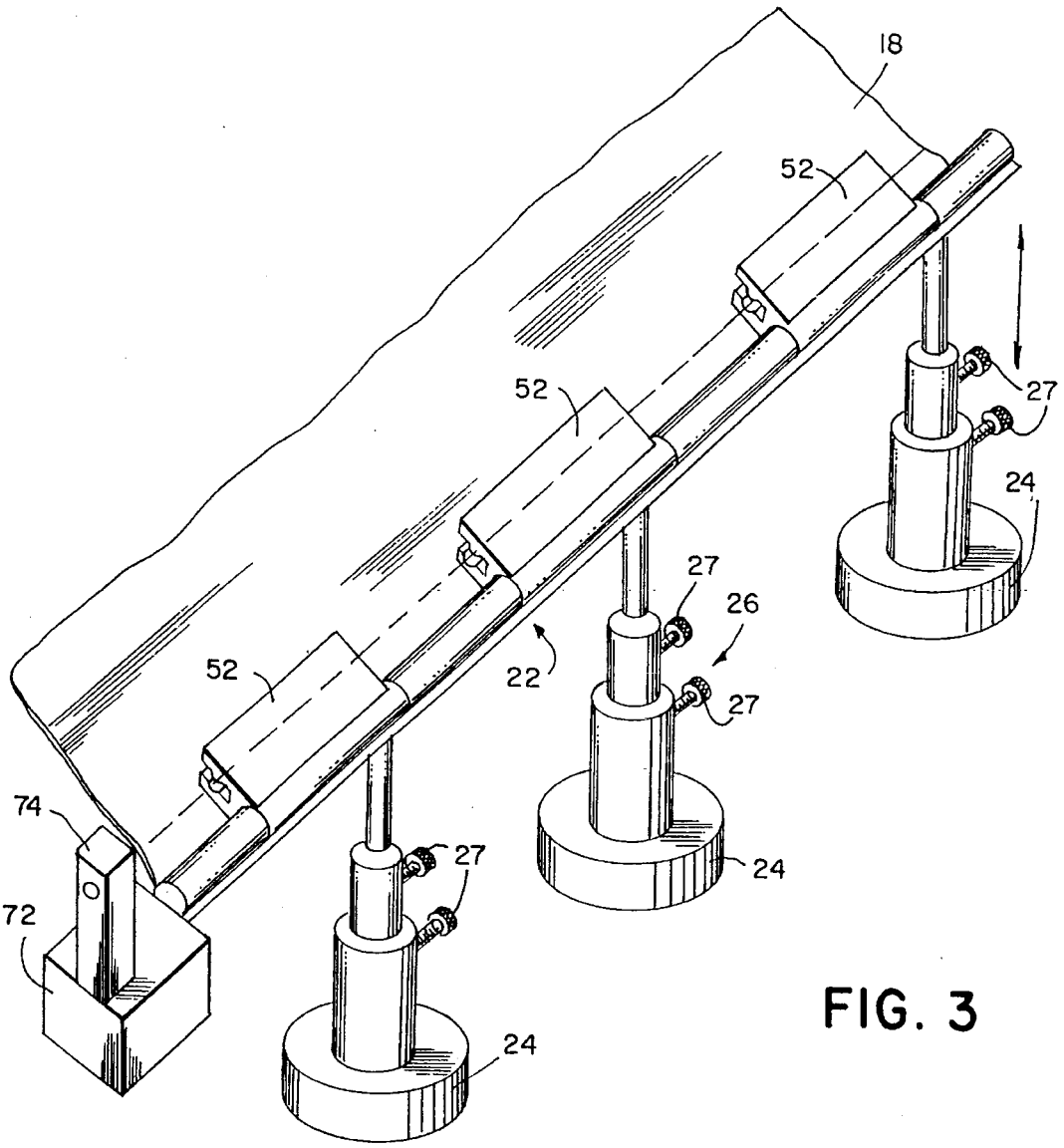
FIG. 3 is a pictorial view of a single drive and support assembly for paired array of panels shown in FIG. 2.
Figure 6:
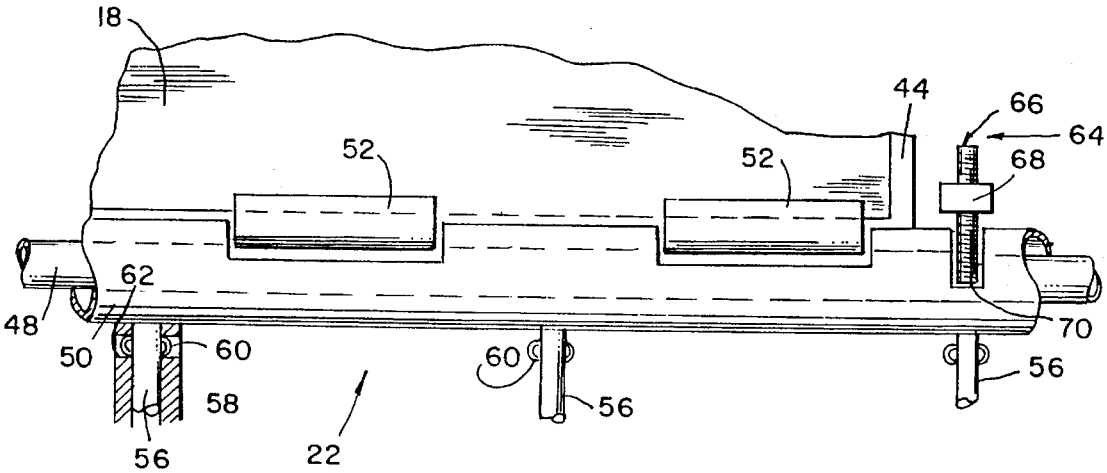
FIG. 6 is a detailed view of a section of a drive shaft, shaft bearing member, extension support legs and panel snap-on holder illustrating the relationship between these various components of the system shown in FIGS. 2 and 3.

Referring now to FIGS. 3 and 6, there is shown a support assembly 22 in greater detail. An overall view of assembly 22 is depicted in FIGS. 3 through 6, comprising a drive shaft 48 coaxially supported by a shaft bearing member 50, a plurality of snap-in panel holders 52 that are fixedly attached to drive shaft 48, with a suitable bonding material. The drive shaft 48 is preferably of a light weight metal, but may be of an appropriate plastic material, while the snap-in panel holders are preferrably of a plastic material, having suitable flexibility for receiving panel members 18 and 20. As shown in FIG. 5, snap-in holders 52 have a receiving slot 54 formed therein that is designed to fit snugly with panel 18 and 20, and has been formed to operate satisfactorily under extreme counter-levered conditions which may be encountered by panels having dimensions greater than four feet wide and eight feet in length. It must be noted that the weight of each panel with an accumulation of one or two inches of snow along the length thereof is less that several pounds and generally under such conditions resides on the panels for a short period of time before the snow is removed by the sweeping-throw motion of each panel during the snow removal process or cycles.

Returning to the discussion of FIG. 6, it can be seen how panel 18 is disposed in and supported by snap-in holder 52, the combination being supported by shaft bearing member 50. Also shown in FIG. 6 are a plurality of extendable leg connections 56 for receiving an upper end 58 of extendable support legs 26. Leg connections 26 are fixedly attached to the outer surface of shaft bearing member 50, such as by welding when member 50 is of metal. Leg connection 56 is provided with spring actuated locking device 60, that locks snugly into a groove 62 found in the upper end 58 of extendable support legs 26 to thereby provide rugged support for the system. It should be noted that additional firmness and snugness at the joint connection may be enhanced by the use of more than one device 60 and groove 62 along the length of connection 56 and leg end 58. Also shown in FIGS. 2 and 6, is a counter-balancing weight device 64, consisting of a threaded element 66 and a threaded weight element 68 which is movable along threaded element 66 by screw rotation of weight 68 by means in the body thereof which is compatible with threads of element 66. As shown in FIG. 6, threaded element 66 is screwed into drive shaft 48 and will rotate therewith. This device is readily removable upon disassembly of the system and may serve as support for a sensing device and as an electrical contact and sensing point in the system, A groove 70 in the bearing member 50 enables device 64 to move freely as shaft 48 rotates. Counter-balancing weight device 64 provides a dampening-stabilizing and balancing effect in the sweeping-throw motion and return of the panel array. Proper adjustment of device 64 permits the rotational sweeping-throw motion of each panel to be substantially uniform and smooth during the back and forth or loaded and unloaded motion. It should be noted that device 64 operates as a counter balance to panels 18 and 20, to thereby reduce the stress and strain on drive device 72.

Referring now to FIGS. 2 and 3, there is shown a plurality of weighted foot support members 24, which anchor the system on the ground at a site location. The weight of each member 24 depends upon and is selected upon the size of panels, their weight and the like. As shown each weighted foot support member 24 is adapted to receive an extendable support leg assembly 26 that is firmly connected thereto by one or more means known in the prior art. As shown in FIGS. 2 and 3, the extendable support leg assembly 26 is of a telescoping type shown in a three section version and may be held in fixed locked position by mechanical devices 27 known in the prior art by manual adjustment, however, extendable support leg assembly may be of a hydraulic-automatic version, responsive to an electrical signal fed thereto for activation.

In FIGS. 2 and 3, there is shown an electrical drive device or system 72 for each panel array 18 and 20. Drive device 72 is linked [directed] directly to drive shaft 48 to provide drive power for the panel arrays 18 and 20 for their rotation in their sweeping-throw motion in an arc of a circle, to thereby cause the removal of falling snow which may have accumulated thereon during repeated cycles. Drive device 74 may contain, for example, a toll gate type motor actuated device that is adapted to be compatible with the snow prevention and removal system 16 of the present invention. More specifically, the angle of rotation, the frequency and speed of each cycle is selected to accommodate a specific design. The motor driven device 72 also provides means by which other electrical functions of the system are supplied by appropriate electrical connections, for example electricity to the electrical heater elements, shown in FIG. 7, the extendable support legs which may be electrically actuated in accordance with certain embodiments of the invention and to activate snow depth sensing devices and the like. Also shown in FIGS. 2 and 3, is a sensing device 78, which may be a microelectronic ultrasonic or photo-electric device for examples, utilized to detect the depth of accumulated snow fall on panels 18 and 20, and to produce an electrical signal for initiating a sweeping-throw cycle of panels 18 and 20. There is also shown a snow deflector shield or covering 76 which extends along the entire length of each panel 18 and 20 suitably mounted and connected thereto in the region containing drive shaft assembly 22 and the plurality of snap-in panel holders 52 to prevent the accumulation of snow thereon that may cause ice to form in the critical area of panel cyclical rotation and to facilitate snow removal. It is understood that only a small segment of covering 76 is shown, but it extends the full length of each panel 18 and 20. Coverings 76 are preferably of light weight plastic material having high non-snow adherence properties.

It should be noted that each counter-balancing weight device 64 contains a microswitch device attached thereto, that is part of the electrical system of the apparatus for snow removal system 16, which generates an electric signal whenever either one of devices 64 encounters an obstruction or resistance from snow pilings that hinders or restricts their downward movement during each panel array sweeping-throw rotational and return motion, which signal is used by the electrical system of the present invention to actuate electrically driven version of extendable support legs 26 used for such purposes.

Referring now to FIG. 7, there is shown an embodiment of snow prevention and removal system 16 depicted in the open position in which certain aspects of the present invention are described in greater detail. More specifically, extendable support leg assembly 26 is depicted as having a plurality of electrically actuate telescopically extendable legs 79. These legs are shown in a fully extended position of three sections, which may be in excess of six feet in length so as to protect selected passageway areas that may be subjected to extremely heavy snow fall conditions. The panel arrays 18 and 20 are raised in three incremental steps in unison with one another in response to signals from a remote control unit 80 or from a signal generated from either of counter-balancing weight devices 64, only one device is shown, and sensing device 74, which may be a micro-switch that senses an obstruction encountered by either counter-balancing weight devices 64 caused by a build up of a snow pile along the length of either panel. As shown in FIGS. 1 and 7, a snow drift-shield 34 is provided as an aid to prevent snow from sliding or drifting onto a passageway 12 as discussed in connection with FIG. 1.

Also shown in FIG. 7, are a plurality of micro-switch devices 82, associated with member segments 36 and 37, the details of which are shown in FIG. 8, that is a combination of sections of panel arrays 18 and 20 shown in the encircled areas designated C and D of FIG. 7. These micro-switch devices 82 may be utilized as directed sensing devices for determining the amount of snow accumulated on the panels 18 and 20, when preselected weight causes sensing devices 82 to be triggered. This mode of operation may be utilized alternatively or in conjunction with ultrasonic detector 78 for a similar function. It should be noted that either device, i.e. sensor 78 or 82 have been found to provide satisfactory results and the selection of one over the other is a matter of cost consideration in the use of either one or the other or both in a particular system.

Also shown in FIG. 7 is an electrical heater element 84 illustrating the pattern therefor, only one pattern is depicted on panel 20, but it is understood that a similar pattern arrangement may be provided for each paired panel array depending upon the design requirements of a specific system. The electrical power requirements to operate these heater elements is fed thereto from control unit 80 through cable connection 86 and drive system 72, which provides a means for controlling the desired temperature levels thereof.

Further in FIG. 7, there is shown a male extension 114 at the remote end of drive shaft 48 having a square configuration; also shown in a female end extension 116 at the front end of another drive shaft 48 which represents a modified front end of shaft 48 that is shown connected to drive unit 72. These extensions 116 depict the ends of drive shaft 48 which have been adapted for use with panel arrays that may be utilized to increase the length of panel arrays 18 and 20 without the need to use additional drive units 72. Female extensions 116 has an aperture 118 therein to receive male extension 114. Extension 116 has a fastening device 120 utilized to firmly connect these members 114 and 116 together so that the addition of one or more panels by such means will readily be rotated as though the drive unit was connected thereto. It is to be understood that the same electrical connection made to panels 18 and 20 connected to drive unit 72 are provided so that a panel array with added sections will operate as a single panel on each multi-panel array. In the preferred embodiment only two additional panel are added to the array.

To continue with the description of the inventive concept of the system, reference is now made to FIG. 9, in which there is shown a block schematic 88, comprising a pair of electrical power input connections 90 to control unit 80 having an output cable 86 connected therebetween to the other electrical components. As shown in diagram 88 two drive units 72 are mechanically linked to drive shafts 48, the connection designated by reference 92, and drive units 72 are electrically connected to their respective panel arrays 18 and 20 at input terminals 94. As shown panel heaters 84 are connected to input terminals 94 for electrical power to such heaters. The temperatures of these heaters may be controlled by suitable thermostatic temperature device 122. As depicted in the diagram an adhesive-resistance plastic material 110 covers panel 18, such that the heater element is hidden from view. Other components of the snow removal system 16 as shown connected thereto, i.e. electrically telescopically extendable legs 79, sensor device 78, sensing device 74, counter-balancing weight device 104 and switching device 28.

Control signals are fed to drive unit 72 from remote control and monitor 96. The primary function of signals inputted along conductor 96 is to provide control of the duration and frequency of the sweeping-throw rotation and return motion of the panel arrays 18 and 20. The desired control signals inputted to the drive unit 72 are determined by a preselected code fed into the system by use of remote control unit and monitor 80 with the use of a digital computer key pad panel 112, that operates a code to actuate a desired signal. Digital computer 112 operation is by means of an internal binary device within control unit 80 based upon boolean algebra as is well known in the prior art.

As shown in the diagram of FIG. 9, each electrical circuit component is appropriately connected to remote control unit 80 through cable 86. Switching device 28, shown open, is normally closed and may be closed or opened manually to permit panels 18 and 20 to be in the open or closed position so as to permit ingress and egress along a passageway, such as driveway 12 of FIG. 1 and may be closed from remote control unit 80 or manually by switch 28 as a subsequent event.

Both sensors 74 and 78 function to determine when and whether the panel arrays 18 and 20 should be raised. With respect to sensor 78, which may be a simple micro-switch with reset capabilities, when it is activated by balancing weight 64 encountering resistance or an obstruction to its normal rotational motion, sensor 78 sends an output signal 104 to input terminal 106 of electrically operated leg device 79 to actuate it for one step upward movement. When the panels 18 and 20 have completed their upward move an output signal 98 is sent to input terminal 100 o sensor 78 so as to reset it for another event.

In a somewhat similar manner, when sensor 74 is activated by an appropriate ultrasonic event, it generates an output signal 108 which is fed to input terminal 109 of electrically operated leg device 79 to actuate it for one step upward movement when the panels 18 and 20 have completed their upward movement by extendable leg 26 moving up one step, an output signal 98 from electrically telescopically extendable legs device 79 is fed to an input terminal 102 of sensor device 74 so as to reset sensor 74 for a subsequent event. As shown, a bias voltage 113 is provided to sensor device 74 since it is an active device, i.e. transmitting ultrasonic signals and receiving echoed signals when it encounters an accumulation of snow on the panel arrays from time to time, and thereby generates output signal 108.

When it is desirable to lower the telescopically extended legs of device 79 a signal from the control unit 80 is fed to device 79 through an electrical connection 115, so as to reset the device to its original lowered position.

Referring now to FIG. 10, there is shown a list of representative functions to be performed utilizing control unit 80. As indicated each of the represented functions may be assigned individual binary codes by the operator or by preset codes so as to facilitate ease of operation of the system from a remote location.

Finally referring now to FIG. 11, there is shown an alternative embodiment of the present invention directed specifically to a passageway such as a sidewalk 124, wherein it is covered by a single row of panel array 126, comprising a single row of panels 128 supported by support assembly 22 of the type shown in FIG. 6, which is connected to a drive unit 72. Also shown is a sensor 78, a plurality of extendable support legs 26 supported by weighted foot member 24 and connected at their upper extensions to support assembly 22. To continue, there is shown a stop-support member 130 connected to a plurality of extendable support legs 26', stop-support member 130 has a snow-shield member 132 connected thereto extending down to ground level. As can be seen in FIG. 11, panel 128 is in the open position, and its range of rotational motion is indicated by a first broken line 134 while its near horizontal position is shown by a second broken line 136 which illustrates the panel 128 is supported by stop-support member 130 when the array is in the closed position. Weight 64 is not shown in FIG. 11 but it and associated sensor 74 are connected to support assembly 22 as shown in FIGS. 2 and 7 and have the same functions in the various embodiments. Operation of this embodiment is similar to that discussed herein with respect to FIGS. 2, 7 and 9.

It is believed that the foregoing disclosure, drawings and teachings of the present invention readily and adequately demonstrate that the snow prevention and removal system hereof provides systems that are new, useful and unobvious. It is to be clearly understood that the above described embodiments are only illustrative of the principles applicable to the invention. Various other arrangements or modifications may be defined by those skilled in the art without departing from the spirit and scope of the invention. For example, the panel array arrangement may readily adapted to be utilized on the roof of a selected residential structure to prevent the accumulation of snow and the removal thereof by means of a single panel array disposed near selected edges of the roof. When the snow accumulated on the panel is thrown to the ground it would eliminate the possible formation and accumulation of undesirable ice in the rain gutters or the formation of dangling icicles from the edge of the roof that often result from the presence of large amounts of snow accumulated thereon. The formation of such ice and icicles often occur when the accumulated snow begins to melt during the day time sun exposure and freezes after the sun sets. Consequently, it is understood that the present invention is intended to cover such modifications and the invention is limited only by the spirit and scope of the descriptive disclosure, content of the drawings and the appended claims.

What is claimed as new is:

1. A passageway coverage assembly system for preventing and eliminating the accumulation of fallen snow on ingress and egress passageway at ground level to buildings so as to permit vehicle and pedestrian traffic therealong, said assembly comprising:

a. a plurality of paired array of panels of selected lengths and widths disposed in a cooperative spaced relationship to cover passageways for catching and accumulating fallen snow thereon and the periodic removal of accumulating fallen snow;

b. plurality of drive shaft support assemblies of selected lengths including a drive shaft having a first and second end, a shaft bearing member and a plurality of snap-in panel holders connected to said drive shafts at spaced apart distances along said support assembly adapted to receive and support said panels in substantially fixed spaced relationship along their respective lengths;

c. a plurality of weighted support members disposed at ground level below each of said panels and drive shaft support assemblies fixedly connected to a corresponding plurality of vertically extendable support legs of selected lengths fixedly connected to each of said drive shafts bearing support assemblies at spaced apart positions along the lengths thereof to support said panels and drive shaft support assemblies above and along ingress and egress passageways;

d. an electrical drive device connected to said first end of each of said drive shafts to provide rotational motion of said panels through an arc of a circle, where said drive shafts act as the axis of rotational motion for said panels to thereby effect the periodic removal of caught snow that accumulates on said panels along their respective widths and lengths;

e. an electrical circuit with power input which actuate and control rotational motion and operation of said electrical drive device, drive shaft and panels responsive to selected period signal inputs; and f. a snow-drift shield having a length corresponding to a length of each drive shaft support assembly and a height corresponding to the extendable lengths of a plurality of vertically extendable support legs, said shield being adjustable to a height corresponding to selected lengths of said support legs, said shield being appropriately affixed to said drive shaft bearing support assembly and disposed vertically to prevent both falling snow and accumulated snow removed from said panels to drift onto covered passageways.

2. The passageway coverage assembly system of claim 1, which include an electrical heater element in each of said panels and said electrical circuit provides electrical signals to said drive devices, heater elements, extendable support leg assemblies and respond to electrical signals from a plurality of sensing devices include in said system.

3. The passageway coverage assembly system of claim 2, in which the height of said panels are manually or electrically actuated for height adjustment.

4. The passageway coverage assembly system of claim 3, in which said electrically actuated extendable legs are actuated by a hydraulic driven device.

5. The passageway coverage assembly system of claim 3, which includes a remote electrical control unit for operation of the system.

6. The passageway coverage assembly system of claim 5, which includes a plurality of sensor devices adapted to provide signals to actuate said devices and extendable leg assemblies.

7. The passageway coverage assembly system of claim 5, in which said passageways are driveways.

8. The passageway coverage assembly system of claim 7, which includes a switching device at the panel assembly site for manually interrupting or starting the operational cycle of said system.

9. The passageway assembly system of claim 8, in which said panels have a non-adherence plastic outer covering material.

10. A passageway coverage assembly system for preventing and eliminating the accumulation of falling snow on ingress and egress passageways at ground level to buildings so as to permit traffic flow therealong, said assembly comprising:

a. single row of one or more panels of selected length and width connected end to end and disposed to cover passageways for catching and accumulating falling snow thereon and for periodic removal of accumulating of fallen snow;

b. a single row of one or more drive shaft support assemblies of selected lengths, including a drive shaft having a first and second end, a shaft bearing member, and a plurality of snap-in panel holders connected to said drive shafts at spaced apart distances along said length of said support assemblies adapted to receive and support said panels in a single row along their respective lengths;

c. a first plurality of weighted support members disposed at ground level below said panels and drive shaft support assemblies fixedly connected to a corresponding plurality of vertically extendable support legs fixedly connected to a drive shaft bearing support assembly at spaced apart positions along the lengths thereof to support said panels and drive shaft bearing support assembly above and along ingress and egress passageways;

d. an electrical drive device connected to said first end of each of said drive shafts to provide rotational motion of said panels through an arc of a circle, where said drive shafts act as an axis of rotational motion for said panels to thereby effect the periodic removal of caught snow that accumulates on said panels along their respective widths and lengths;

e. an electrical circuit with power input which actuate and control the rotational motion and operation of said electrical drive, drive shaft and panels responsive to selected periodic signal inputs;

f. a snow-drift shield having a length corresponding to a length of each drive shaft support assembly and a height corresponding to the extendable lengths of said vertically extendable support legs, said shield being adjustable to a height corresponding to selected lengths of said support legs, said shield being appropriately affixed to said drive shaft bearing support assembly and disposed vertically to prevent both fallen snow and accumulated snow removed from panels to drift onto said covered passageways; and g. a second plurality of weighted support members disposed at ground level opposite each of said first plurality of weighted support members and below a horizontally disposed stop-support member that is fixedly connected to a corresponding plurality of vertically extendable support legs fixedly connected to said stop-support member at spaced apart positions along a selected length thereof so as to provide a stop position for said panels during each sweep-throw rotation cycle of a panel assembly.

11. The passageway coverage assembly system of claim 10, in which the height of panels and stop-support members are manually actuated for height adjustments.

12. The passageway coverage assembly system of claim 11, in which said electrically extendable legs are adjusted by hydraulic driven devices.

13. The passageway coverage assembly system of claim 12, which includes a remote electrical control circuit unit for operation of the system.

14. The passageway coverage system of claim 13, which includes a plurality of sensor devices which provide signals to actuate said drive devices and extendable leg assemblies.

15. The passageway coverage assembly system of claim 14, which includes an electrical heater element in each panel and said electrical circuit provides electrical signals to said drive device, heater element and sensors.

16. A method for preventing falling snow from accumulating on ingress and egress ground traffic passageways, the steps comprising:

a. covering a selected length of said ingress and egress ground traffic passageway surfaces with an array of panels disposed along and above said selected lengths thereof;

b. disposing and adapting panel array along said selected passageway surfaces so as to catch falling snow before it reaches covered passageway surface;

c. providing support means for holding and varying the height of said panels above said surfaces; and d. providing electrical circuit means connected to a panel array for actuating said panel through an arc of a circle so as to periodically remove snow therefrom which may be caught and accumulated thereon.

17. The passageway coverage assembly system of claim 1, in which passageways are driveways.

18. The passageway coverage assembly system of claim 10, in which the height of panels and stop-support members are electrically actuated for height adjustments.

* * * * *